US008525738B2

(12) United States Patent
Wu et al.

(10) Patent No.: US 8,525,738 B2
(45) Date of Patent: Sep. 3, 2013

(54) WIRELESS COMMUNICATION DEVICE AND METHOD THEREOF

(75) Inventors: Wei-Yang Wu, Taoyuan County (TW); Hsiao-Chuan Lin, Taoyuan County (TW)

(73) Assignee: HTC Corporation, Taoyuan County (TW)

( * ) Notice: Subject to any disclaimer, the term of this patent is extended or adjusted under 35 U.S.C. 154(b) by 434 days.

(21) Appl. No.: 12/879,021

(22) Filed: Sep. 10, 2010

(65) Prior Publication Data

US 2011/0194589 A1 Aug. 11, 2011

(30) Foreign Application Priority Data

Feb. 11, 2010 (TW) ..... 99104483 A

(51) Int. Cl.
*H01B 1/24* (2006.01)

(52) U.S. Cl.
USPC ..... 343/702; 343/901

(58) Field of Classification Search
USPC ..... 343/702, 901
See application file for complete search history.

(56) References Cited

U.S. PATENT DOCUMENTS 5,644,320 A * 7/1997 Rossi ..... 343/702
5,812,093 A 9/1998 Thompson et al.
6,809,775 B2 10/2004 Yule
6,917,328 B2 7/2005 Rabinowitz et al.
7,425,923 B2 * 9/2008 Ko et al. ..... 343/702
2002/0033773 A1 * 3/2002 Hirabayashi ..... 343/702

FOREIGN PATENT DOCUMENTS

CN 1152805 6/1997
CN 1236200 11/1999
EP 1708305 10/2006

OTHER PUBLICATIONS

"Extended Search Report of European Counterpart Application", issued on Feb. 2, 2011, p. 1-p. 5.
"First Office Action of China Counterpart Application", issued on Mar. 14, 2013, p. 1-p. 8.

* cited by examiner

*Primary Examiner* — Dieu H Duong
(74) *Attorney, Agent, or Firm* — Jianq Chyun IP Office

(57) ABSTRACT

A wireless communication device including a system ground plane and a retractable antenna is provided. The system ground plane includes a feed point. When the retractable antenna is configured to be a first length, the wireless communication device transceives a first signal of a first bandwidth through the retractable antenna for a first radio frequency system. When the retractable antenna is configured to be a second length, the wireless communication device transceives the first signal and a second signal of a second bandwidth through the retractable antenna respectively for the first radio frequency system and the second radio frequency system. A center frequency of the first bandwidth range is substantially a first odd multiple of a reference frequency, and a center frequency of the second bandwidth range is substantially a second odd multiple of the reference frequency, and the first odd multiple is different to the second odd multiple.

14 Claims, 8 Drawing Sheets

2000A

2000B

WIRELESS COMMUNICATION DEVICE AND METHOD THEREOF

CROSS-REFERENCE TO RELATED APPLICATION

This application claims the priority benefit of Taiwan application serial No. 99104483, filed on Feb. 1, 2010. The entirety of the above-mentioned patent application is hereby incorporated by reference herein and made a part of this specification.

BACKGROUND OF THE INVENTION

1. Field of the Invention

The present invention relates to a wireless communication device. More particularly, the present invention relates to a wireless communication device including a retractable antenna.

2. Description of Related Art

With development of wireless communication technology, wireless communication devices are widely used in various occasions and applications thereof are diversified. For example, various portable wireless communication devices such as mobile phones, smart phones, multimedia players, personal digital assistants (PDA) and satellite navigators, etc. are developed and become commonly used electronic products in people's daily life.

Generally, regarding a method for the wireless communication device receiving and processing a signal, an antenna is first used to receive the signal, and then the signal received by the antenna is transmitted to a circuit for a series of processing. Therefore, design of the antenna in the wireless communication device is very important.

In the related art, the conventional wireless communication device requires two antennas to simultaneously support global positioning system (GPS) signals and a digital video broadcasting-T/H (DVB-T/H) system, wherein one antenna is used for supporting the GPS signals, and another antenna is used for supporting the DVB-T/H system, so that a cost of the wireless communication device is increased, and a utilization convenience thereof is reduced.

SUMMARY OF THE INVENTION

The present invention is directed to a wireless communication device and a wireless communication method, in which a single antenna is used to transceive a first signal and a second signal respectively corresponding to a first radio frequency system and a second radio frequency system.

The present invention provides a wireless communication device. The wireless communication device includes a system ground surface and a retractable antenna. The system ground surface includes a feed point. The retractable antenna is coupled to the feed point. When the retractable antenna is configured to be a first length, the wireless communication device transceives a first signal of a first bandwidth range through the retractable antenna for a first radio frequency (RF) system. When the retractable antenna is configured to be a second length, the wireless communication device transceives the first signal of the first bandwidth range and a second signal of a second bandwidth range through the retractable antenna respectively for the first RF system and a second RF system. A center frequency of the first bandwidth range is substantially a first odd multiple of a reference frequency, and a center frequency of the second bandwidth range is substantially a second odd multiple of the reference frequency, wherein the first odd multiple is different to the second odd multiple.

In an embodiment of the present invention, the second length is greater than the first length.

In an embodiment of the present invention, the system ground surface further includes a ground point. When the retractable antenna is configured to be the first length, the ground point is coupled to the retractable antenna, and when the retractable antenna is configured to be the second length, the ground point is not coupled to the retractable antenna.

In an embodiment of the present invention, the wireless communication device further includes a conductive material. When the retractable antenna is configured to be the first length, the conductive material is coupled between the ground point and the retractable antenna, and when the retractable antenna is configured to be the second length, the conductive material is coupled to the ground point.

In an embodiment of the present invention, the first RF system is a global positioning system (GPS), and the second RF system is a digital video broadcasting (DVB-T/H) system.

In an embodiment of the present invention, the wireless communication device further includes a GPS chip set and a DVB-T/H system chip set. The GPS chip set is coupled to the feed point, and the DVB-T/H system chip set is coupled to the feed point.

In an embodiment of the present invention, the retractable antenna further includes a pivot structure, and the pivot structure is used for changing a direction of the retractable antenna.

In an embodiment of the present invention, the wireless communication device further includes a matching circuit, and the matching circuit is used for adjusting the first bandwidth range.

In an embodiment of the present invention, a resonant frequency of the retractable antennal is an odd multiple of the reference frequency.

The present invention provides a wireless communication method, which is adapted to a wireless communication device, wherein the wireless communication device includes a system ground surface and a retractable antenna. The wireless communication method can be described as follows. The retractable antenna is configured to be a first length, so that the wireless communication device transceives a first signal of a first bandwidth range for a first radio frequency (RF) system. The retractable antenna is configured to be a second length, so that the wireless communication device transceives the first signal and a second signal of a second bandwidth range respectively for the first RF system and a second RF system. A center frequency of the first bandwidth range is substantially a first odd multiple of a reference frequency, and a center frequency of the second bandwidth range is substantially a second odd multiple of the reference frequency, wherein the first odd multiple is different to the second odd multiple.

In an embodiment of the present invention, the wireless communication method further includes adjusting the first bandwidth range through a matching circuit.

According to the above descriptions, in the present invention, the retractable structure of the retractable antenna of the wireless communication device can be used to change the length of the retractable antenna, so that the wireless communication device can use a single retractable antenna to support the first RF system and the second RF system.

In order to make the aforementioned and other features and advantages of the present invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1A:
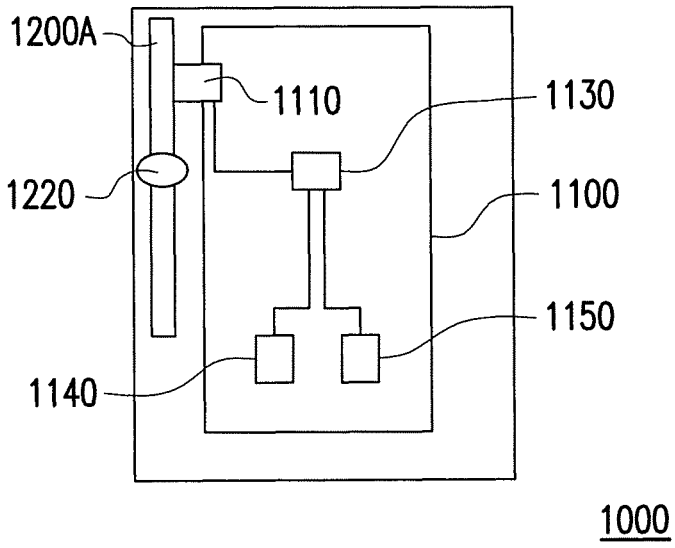
FIGS. 1A-1C are schematic diagrams illustrating a wireless communication device according to an embodiment of the present invention.

A conventional wireless communication device requires two antennas to simultaneously support global positioning system (GPS) signals and a digital video broadcasting (DVB-T/H) system, so that a cost of the wireless communication device is increased, and a utilization convenience thereof is reduced.

Accordingly, embodiments of the present invention provide a retractable antenna having a retractable structure, which is mainly used for changing a radiator length of the retractable antenna. The radiator length of the retractable antenna is referred to as an antenna length hereinafter. When the retractable antenna is accommodated within the wireless communication device, the antenna length of the retractable antenna is configured to be a first length, and the wireless communication device transceives a first signal of a first bandwidth range through the retractable antenna for a first radio frequency (RF) system. When the retractable antenna is pulled out from the wireless communication device, the antenna length of the retractable antenna is configured to be a second length, and the wireless communication device transceives the first signal and a second signal of a second bandwidth range through the retractable antenna respectively for the first RF system and a second RF system.

In detail, when the retractable antenna is configured to be the first length, the wireless communication device can provide a good signal-receiving quality to the first signal of the first bandwidth range. When the retractable antenna is configured to be the second length, the wireless communication device can provide a good signal-receiving quality to the first signal of the first bandwidth range and the second signal of the second bandwidth range. Therefore, only a single retractable antenna is used in the wireless communication device of the embodiments to simultaneously support the GPS signals and the DVB-T/H system, so as to effectively reduce a cost of the wireless communication device and improve the utilization convenience.

Reference will now be made in detail to the embodiments of the present invention, examples of which are illustrated in the accompanying drawings, wherein like reference numerals refer to the like elements or steps throughout.

First Embodiment

Figure 1B:
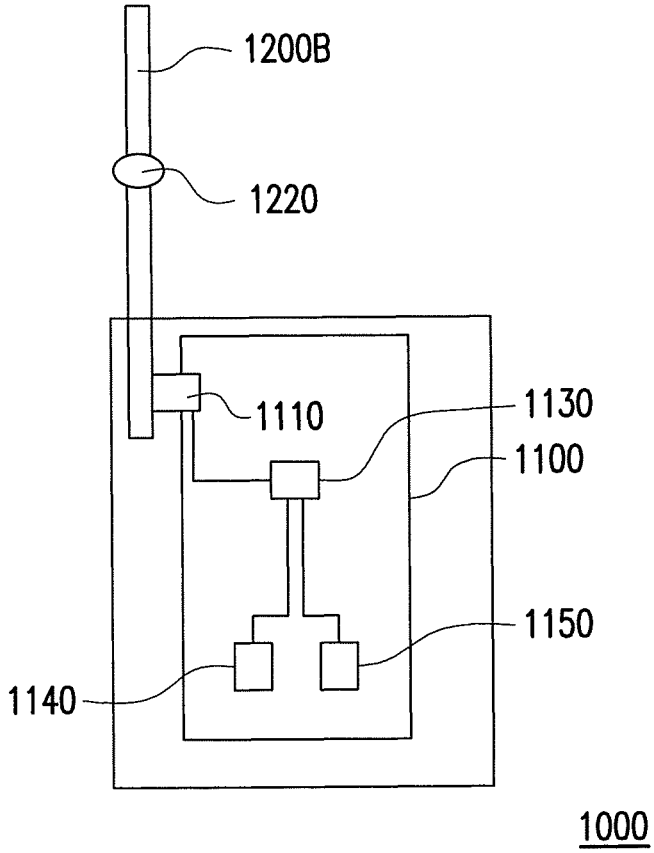
Figure 1C:
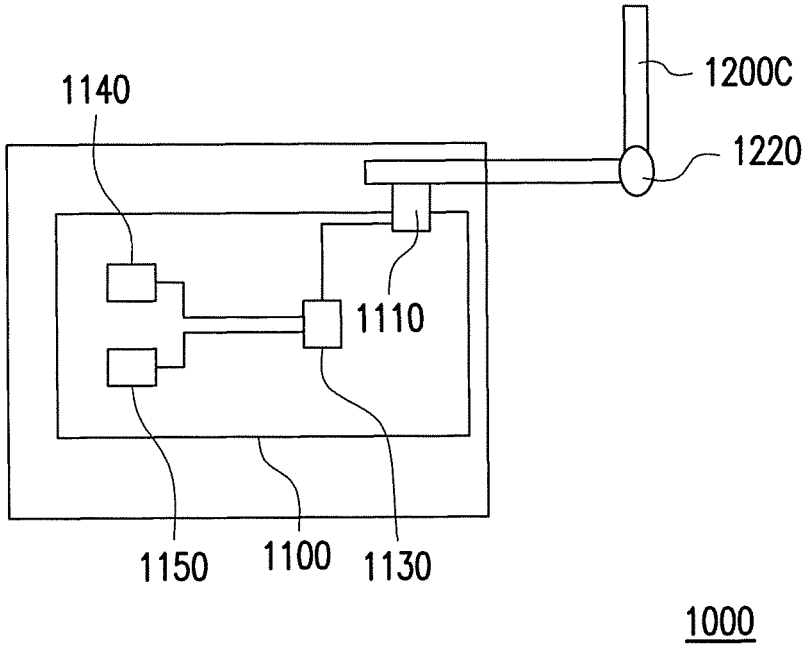

FIGS. 1A-1C are schematic diagrams illustrating a wireless communication device according to an embodiment of the present invention. The wireless communication device of the present embodiment can be a smart phone, a personal digital assistant (PDA), a GPS device, a smartbook, a netbook, a notebook, an ultra-mobile personal computer (UMPC), etc., as long as it can simultaneously support the GPS signals and the DVB-T/H system.

Referring to FIGS. 1A-1C, the wireless communication device 1000 is, for example, a smart phone, in which only a single retractable antenna is used to simultaneously support the GPS signals and the DVB-T/H system, so as to effectively reduce a cost of the wireless communication device and improve the utilization convenience. The wireless communication device of a portrait mode is illustrated in FIGS. 1A-1B, and the wireless communication device of a landscape mode is illustrated in FIG. 1C.

The wireless communication device 1000 includes a system ground plane 1100 and a retractable antenna 1200A, 1200B or 1200C. The system ground plane 1100 is, for example, a plane of a printed circuit board (PCB). The retractable antenna is, for example, disposed on a substrate. The system ground plane 1100 includes a feed point 1110. The retractable antenna 1200A, 1200B or 1200C is coupled to the feed point 1110. The retractable antenna 1200A, 1200B or 1200C includes a retractable structure (not shown), and the retractable structure is used for changing a radiator length of the retractable antenna. For simplicity's sake, the radiator length of the retractable antenna is referred to as an antenna length. It should be noticed that the retractable antennas 1200A-1200C are the same retractable antenna, though it is marked with different reference numbers for the sake of simplicity. Moreover, the retractable antenna also includes a pivot structure 1220.

Figure 4A:
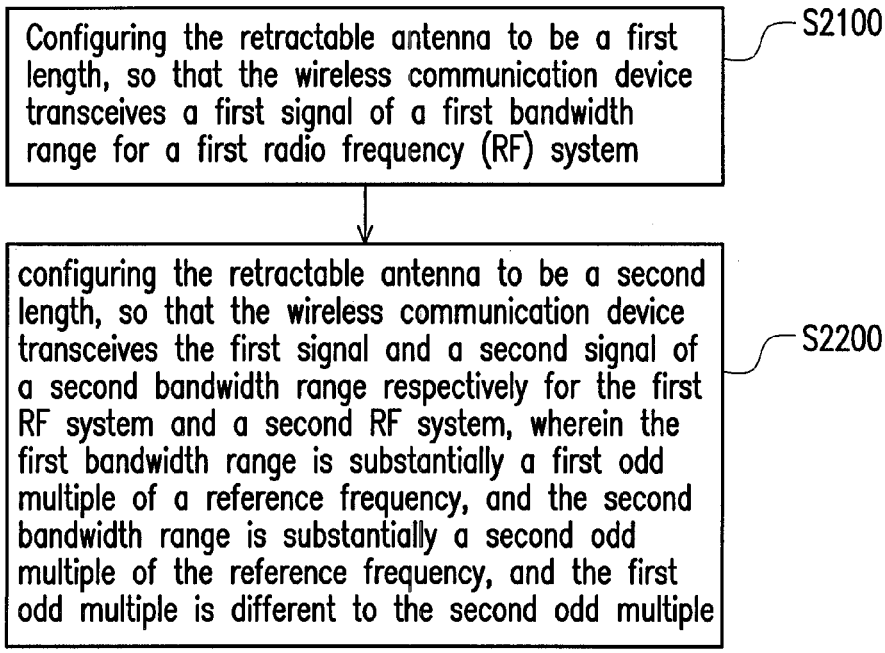
FIGS. 4A and 4B are flowcharts respectively illustrating a wireless communication method according to an embodiment of the present invention.

FIG. 4A is a flowchart illustrating a wireless communication method according to an embodiment of the present invention. Referring to FIG. 1A and FIG. 4A, the wireless communication method 2000A includes steps S2100-S2200. A user uses the wireless communication device 1000 in the portrait mode, and accommodates the retractable antenna 1200A within the wireless communication device 1000. Now, in the step S2100, the retractable antenna 1200A is configured to be the first length, which is, for example, between 3.5 cm and 5.5 cm, and is preferably 4.5 cm. The first length is a corresponding length of 0.25 times of a resonance wavelength (λ) when the wireless communication device 1000 is operated at a GPS frequency (1575 MHz). The wireless communication device 1000 transceives a first signal of a first bandwidth range through the retractable antenna 1200A for a first RF system. The first signal is, for example, a GPS signal, the first bandwidth range is, for example, between 1572 MHz and 1578 MHz, and the first RF system is, for example, the GPS system.

Referring to FIG. 1B and FIG. 4A, the user uses the wireless communication device 1000 in the portrait mode. Now, in the step S2200, the retractable antenna 1200B is configured to be the second length, which is, for example, between 14 cm and 16 cm, and is preferably 15.7 cm. The second length is a corresponding length of 0.25 times of a resonance wavelength (λ) when the wireless communication device 1000 is operated at a DVB-T/H frequency (500 MHz). Moreover, the user can also use the wireless communication device 1000 in the landscape mode, and when the retractable antenna 1200C is configured to be the second length, lengths of the retractable antennas 1200B and 1200C are the same, and only shapes thereof are different, wherein the retractable antenna 1200C has an L-shape, and the retractable antenna 1200B has a linear-shape. The first length is, for example, between 7 cm and 9 cm, which is preferably 8.7 cm, and the second length is, for example, between 14 cm and 16 cm, which is preferably 15.7 cm.

The wireless communication device 1000 transceives the first signal and a second signal of a second bandwidth range through the retractable antenna respectively for the first RF system and a second RF system. The second RF system is, for example, the DVB-T/H system, and the second bandwidth range is, for example, between 450 MHz and 800 MHz. A center frequency of the first bandwidth range is substantially a first odd multiple of a reference frequency, and a center frequency of the second bandwidth range is substantially a second odd multiple of the reference frequency, wherein the first odd multiple is different to the second odd multiple. The first odd multiple is about 3, and the second odd multiple is about 1. The reference frequency is, for example, 500 MHz. It should be noticed that in the present embodiment, the first odd multiple is about 3, and the second odd multiple is about 1, though the present invention is not limited thereto. In the other embodiments, the reference frequency can be 1000 MHz, and the second odd multiple can be about 5, so that the center frequency of the second bandwidth range can be 5000 MHz. In the present embodiment, the wireless communication device 1000 receives signals from two different bandwidth ranges, though the present invention is not limited thereto. In the other embodiments, if center frequencies of bandwidth ranges in different RF systems are substantially odd multiples of the reference frequency, the wireless communication device 1000 can receive signals from other different RF systems. Moreover, a resonant frequency of the retractable antenna 1200A, 1200B or 1200C is an odd multiple of the reference frequency rather than an even multiple of the reference frequency. When the retractable antenna 1200B or 1200C is configured to be the second length, the wireless communication device 100 can be applied to the DVB-T/H system of about 500 MHz, and can also be applied to the GPS of about 1500 MHz. In detail, the retractable antenna 1200B or 1200C is, for example, a single-dipole retractable antenna, and in the present embodiment, the resonant frequency thereof is designed to be about 500 MHz, which can support the DVB-T/H system. Moreover, in case of such antenna length, based on the resonance phenomenon of the frequency, a triple harmonic resonance thereof is about 1500 MHz, which is rather close to a GPS usage band (1575 MHz), so that a suitable matching circuit can be used to shift the resonant frequency to the GPS usage band. Therefore, when the retractable antenna 1200B or 1200C is configured to be the length of 15.7 cm, the wireless communication device 1000 can simultaneously support the DVB-T/H system and the GPS signals.

Accordingly, in the present embodiment, the retractable structure of the retractable antenna 1200A, 1200B or 1200C of the wireless communication device 1000 can be used to change the length of the retractable antenna 1200A, 1200B or 1200C, and in collaboration with a characteristic that the resonant frequency of the retractable antenna 1200A, 1200B or 1200C is an odd multiple of the reference frequency rather than an even multiple of the reference frequency, the wireless communication device 1000 can use a single retractable antenna to simultaneously support the GPS signals and the DVB-T/H system, so as to effectively reduce a cost of the wireless communication device and improve the utilization convenience.

Moreover, in the present embodiment, the second length of the retractable antennal 1200B or 1200C is greater than the first length of the retractable antenna 1200A. The wireless communication device 1000 further includes a GPS chip set 1140 and a DVB-T/H system chip set 1150. The GPS chip set 1140 and the DVB-T/H system chip set 1150 are all coupled to the feed point 1110 through a matching circuit 1130, so as to process the GPS signals and DVB-T/H system signals transceived by the retractable antenna 1200B or 1200C. The device may further include other components, such as a diplexer (not shown) electrically connected between the matching circuit and these two chip sets, though the disclosure is not limited thereto.

Although a possible pattern of the wireless communication device has been described in the above embodiment, it should be understood by those skilled in the art that the design of the wireless communication device varies along with different manufacturers, thus, application of the present invention should not be limited to the possible pattern. In other words, the spirit of the present invention is met as long as a single retractable antenna is used in the wireless communication device to simultaneously support two or more RF systems. Several embodiments are provided below to provide a further understanding of the invention for those skilled in the art.

Second Embodiment

Figure 2A:
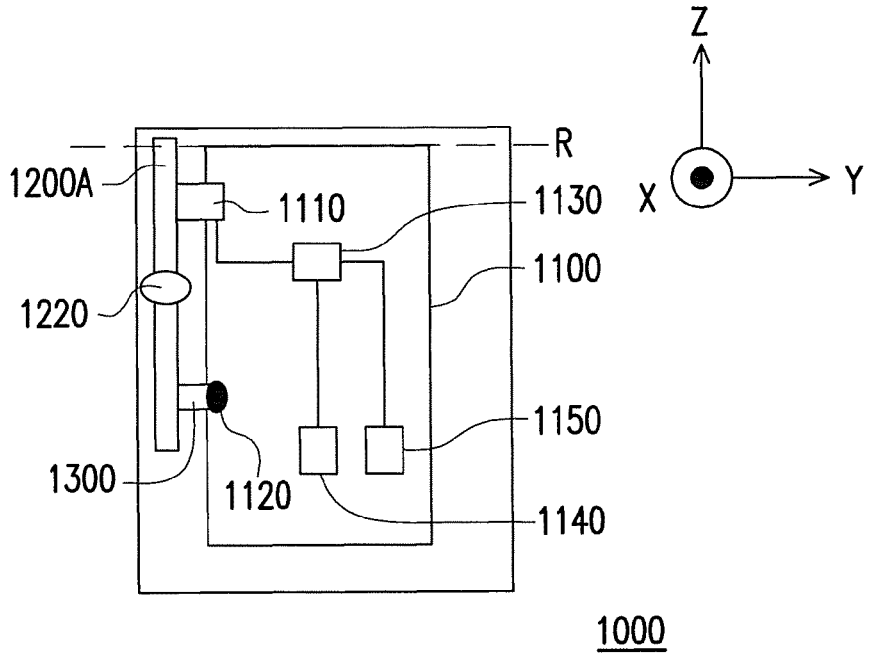
FIGS. 2A-2C are schematic diagrams illustrating a wireless communication device according to an embodiment of the present invention.
Figure 2B:
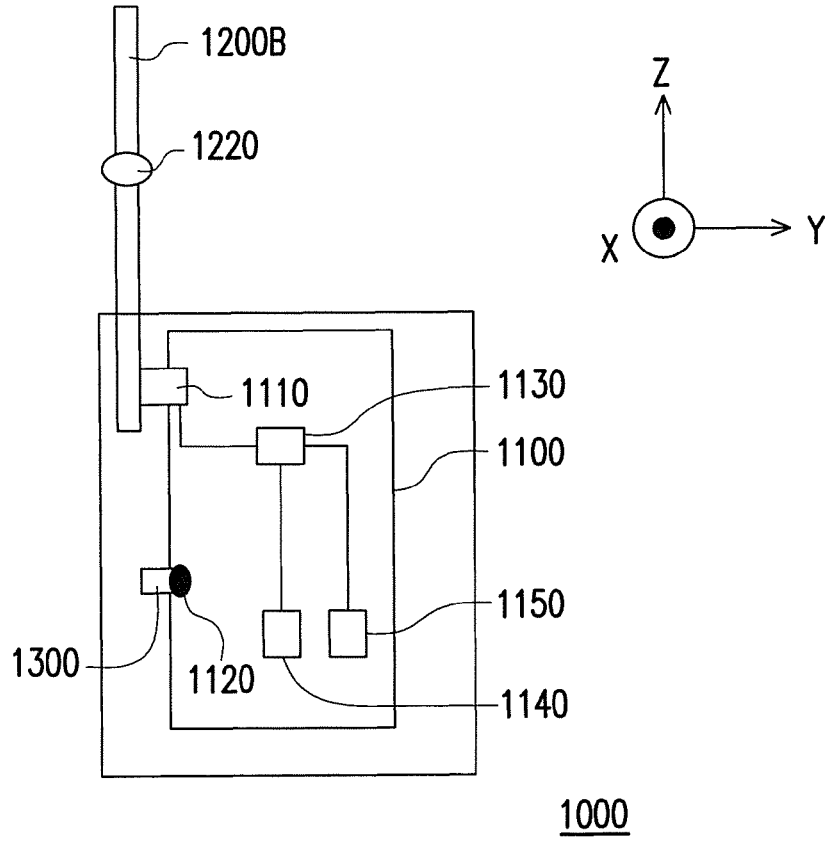
Figure 2C:
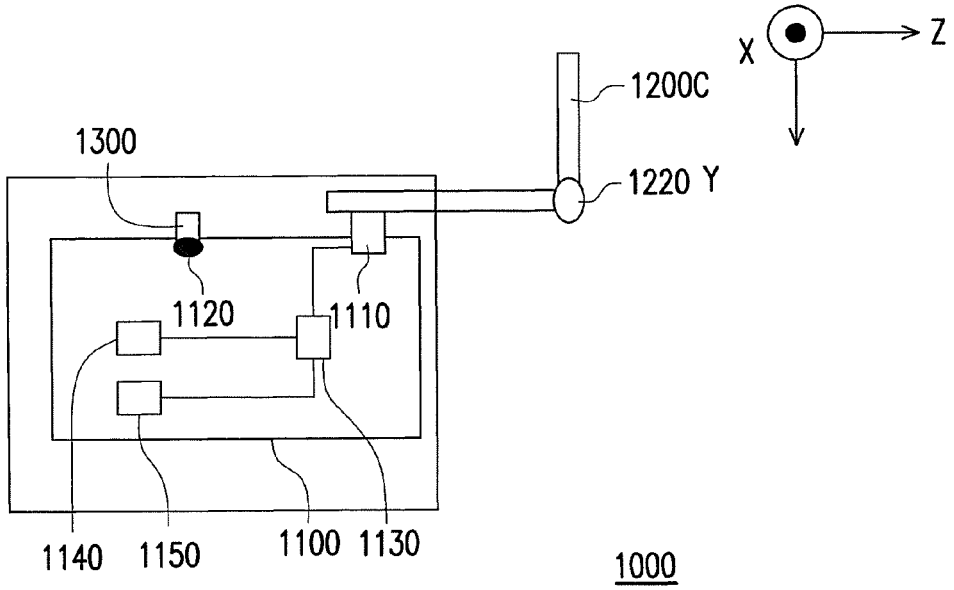

FIGS. 2A-2C are schematic diagrams illustrating a wireless communication device according to an embodiment of the present invention. The wireless communication device 1000 of FIGS. 2A-2C is similar to the wireless communication device 1000 of FIGS. 1A-1B, so that detailed descriptions of the similar components are not repeated.

Referring to FIGS. 2A-2C, the system ground plane 1100 of the wireless communication device 1000 of FIGS. 2A-2C further includes a ground point 1120. When the retractable antenna 1200A is configured to be the first length, the ground point 1120 is coupled to the retractable antenna 1200A. When the retractable antenna 1200B or 1200C is configured to be the second length, the ground point 1120 is not coupled to the retractable antenna, wherein a total length of the retractable antenna 1200B is the same to that of the retractable antenna 1200C, and only shapes thereof are different. The retractable antenna 1200C has an L-shape, and the retractable antenna 1200B has a linear-shape. The first length is, for example, between 7 cm and 9 cm, which is preferably 8.7 cm, and the second length is, for example, between 14 cm and 16 cm, which is preferably 15.7 cm. A distance between the feed point 1100 and the ground point 1120 can be adjusted, so that when the ground point 1120 is coupled to the retractable antenna 1200A, a quality of the first signal transceived by the wireless communication device 1000 is improved. For example, a dot line R is taken as a benchmark, a distance between the feed point 1100 and the dot line R is between 1.5 cm and 3 cm, which is preferably 2.1 cm, and a distance between the ground point 1120 and the dot line R is between 7 cm and 9 cm, which is preferably 8.7 cm, and is a corresponding length of 0.5 times of a resonance wavelength when the wireless communication device 1000 is operated at the GPS frequency (1575 MHz). In other words, assuming a distance between the feed point 1100 and the ground point 1120 is d, an optimal transceiving quality is achieved when the distance d is close to 6.6 cm. When the distance d>6.6 cm, an operating frequency of the wireless communication device 1000 is shifted to be lower than the GPS frequency (1575 MHz), and when the distance d<6.6 cm, the operating frequency of the wireless communication device 1000 is shifted to be higher than the GPS frequency (1575 MHz). Therefore, the quality of the first signal transceived by the wireless communication device 1000 can be improved by adjusting the distance d between the feed point 1100 and the ground point 1120.

It should be noticed that in the present embodiment, the reference frequency can be adjusted by moving a position of the ground point. Moreover, while the length of the retractable antenna is changed, a configuration of the retractable antenna is changed to adjust an operation bandwidth range.

The wireless communication device 1000 of FIGS. 2A-2C further includes a conductive material 1300. The user uses the wireless communication device in the portrait mode, and accommodates the retractable antenna 1200A within the wireless communication device 1000. When the retractable antenna 1200A is configured to be the first length, the conductive material 1300 is coupled between the ground point 1120 and the retractable antenna 1200A. The conductive material 1300 is, for example, a metal spring, a pogo pin or other conductive materials, which is used for electrically connecting the retractable antenna 1200A and the ground point 1120. When the retractable antenna 1200B is configured to be the second length, the conductive material 1300 is coupled to the ground point 1120, and the ground point 1120 is not coupled to the retractable antenna 1200B or 1200C. Moreover, the retractable antenna also includes the pivot structure 1220.

Moreover, in the present embodiment, the wireless communication device 1000 further includes the matching circuit 1130. The matching circuit 1130 is used for adjusting the first resonant frequency of the retractable antenna configured to the second length. For example, when the user pulls out the retractable antenna 1200B or 1200C from the wireless communication device 1000, the retractable antenna 1200B or 1200C is not only adapted to the first bandwidth range, for example, about 1500 MHz, but is also adapted to the second bandwidth range, for example, about 500 MHz. The matching circuit 1130 can fine-tune the first bandwidth range to shift the first bandwidth range to the GPS usage band. Therefore, the quality of the first signal transceived by the wireless communication device 1000 can be improved through the matching circuit 1130.

Accordingly, in the present embodiment, the distance between the feed point 1100 and the ground point 1120 in the wireless communication device 100 can be adjusted, so that when the ground point 1120 is coupled to the retractable antenna 1200A, the resonant frequency of the first signal transceived by the wireless communication device 1000 is adjusted. Moreover, when the ground point 1120 is not coupled to the retractable antenna 1200A, the quality of the first signal transceived by the wireless communication device 1000 can be improved through the matching circuit 1130.

Figure 3A:
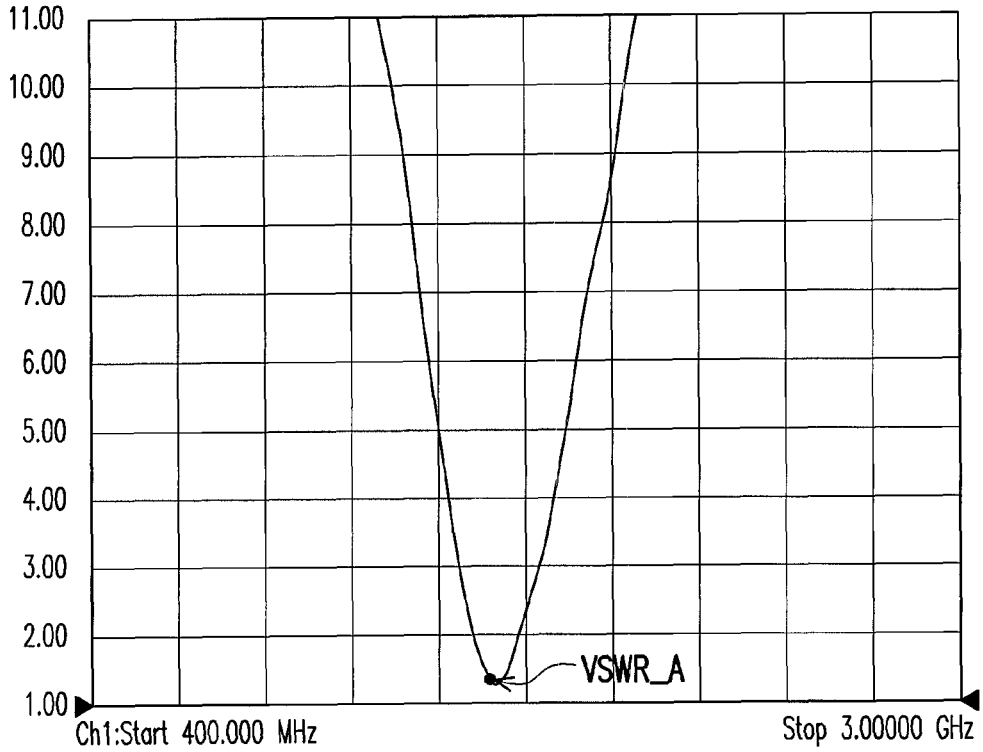
FIGS. 3A-3C are diagrams illustrating relationships between frequency and return loss of signals received by a wireless communication device according to an embodiment of the present invention.
Figure 3B:
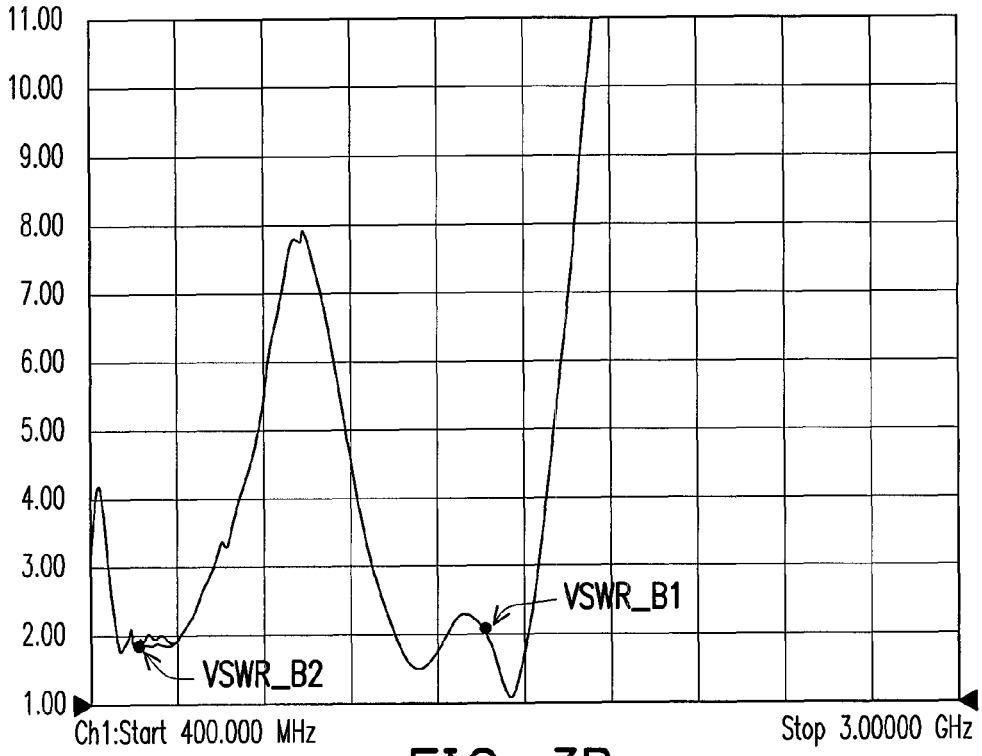
Figure 3C:
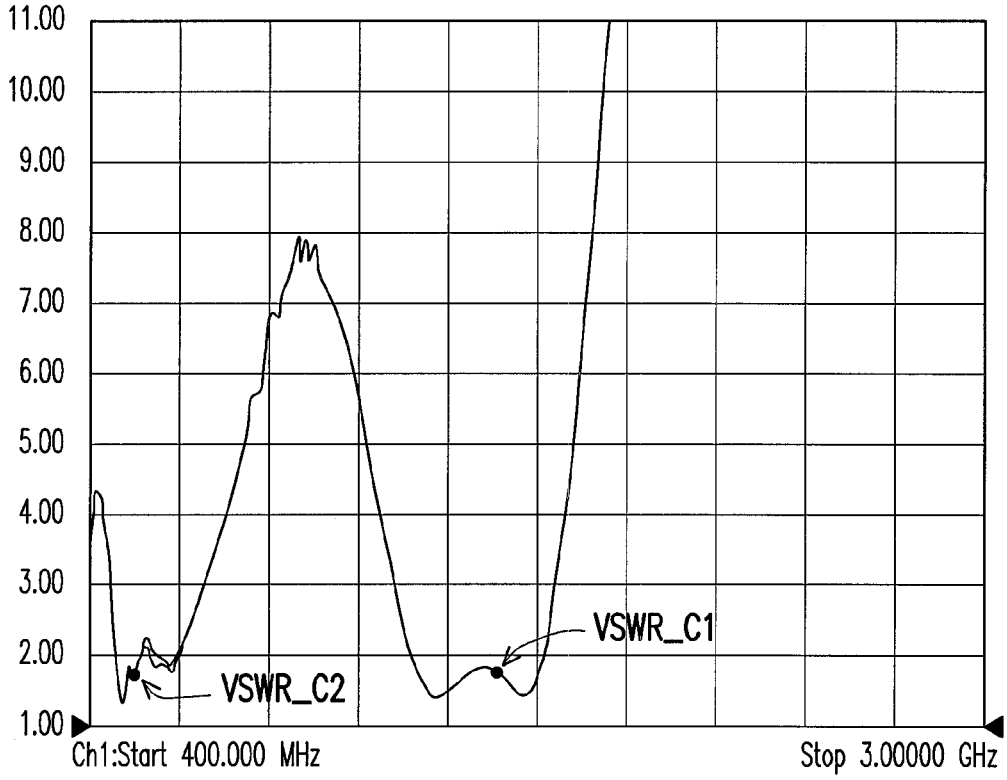

FIGS. 3A-3C are diagrams illustrating return loss of signals received by the wireless communication device according to an embodiment of the present invention. The return loss is generally represented by a voltage standing wave ratio (VSWR).

Referring to FIG. 2A and FIG. 3A, FIG. 3A is diagram illustrating a relation between frequency and return loss measured when the retractable antenna 1200A is configured to be the first length, wherein the wireless communication device 1000 has the portrait mode. The first length is, for example, 8.7 cm. The frequency of the first signal is 1575 MHz, and the VSWR is 1.516 as that shown by a point VSWR_A of FIG. 3A.

Referring to FIGS. 2B and 3B, FIG. 3B is a diagram illustrating a relation between frequency and return loss measured when the retractable antenna 1200B is configured to be the second length, wherein the wireless communication device 1000 has the portrait mode. The second length is, for example, 15.7 cm. The frequency of the first signal is 1575 MHz, and the VSWR is 2.105 as that shown by a point VSWR_B1 of FIG. 3B. The frequency of the second signal is 500 MHz, and the VSWR is 1.9 as that shown by a point VSWR_B2 of FIG. 3B.

Figure 4B:
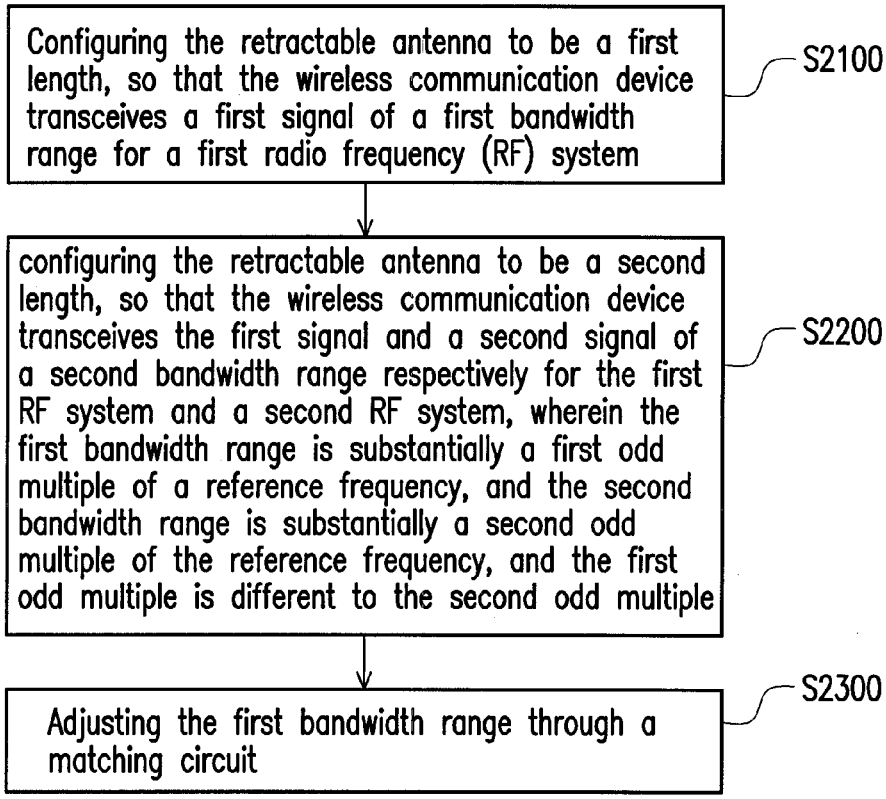

Referring to FIGS. 2C, 3C and 4B, FIG. 3C is a diagram illustrating a relation between frequency and return loss measured when the retractable antenna 1200C is configured to be the second length. FIG. 4B is another flowchart illustrating a wireless communication method according to an embodiment of the present invention. The wireless communication method 2000B includes steps S2100-S2300. The user uses the wireless communication device 1000 in the landscape mode, and pulls out the retractable antenna 1200C from the wireless communication device 1000. In the step S2300, the pivot structure 1220 is used to change a direction of the retractable antenna 1200C. For example, the direction of the retractable antenna of FIGS. 2A and 2B is approximately perpendicular to the direction of the retractable antenna of FIG. 2C. The second length is, for example, 15.7 cm. The frequency of the first signal is 1575 MHz, and the VSWR is 1.778 as that shown by a point VSWR_C1 of FIG. 3C. The frequency of the second signal is 500 MHz, and the VSWR is 1.6 as that shown by a point VSWR_C2 of FIG. 3C. Therefore, by using the pivot structure 1220 to change the direction of the retractable antenna 12000, the qualities of the first signal and the second signal transceived by the wireless communication device 1000 in the landscape mode can still be maintained. In other words, regardless that the user uses the wireless communication device in the portrait mode or the landscape mode, the design of the retractable antenna of the present embodiment can ensure the wireless communication device simultaneously supporting the GPS signals and the DVB-T/H system.

Figure 5A:
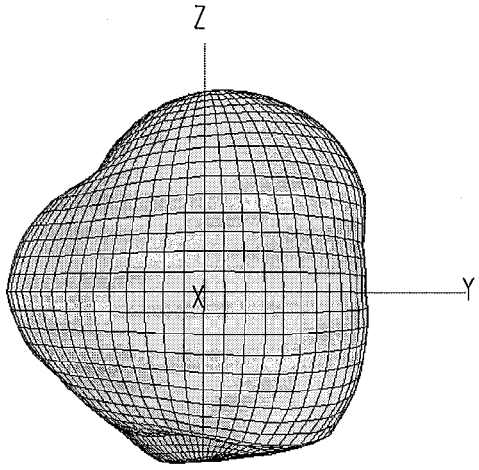
FIGS. 5A-5C are schematic diagrams illustrating radiation patterns of signals transceived by a wireless communication device according to an embodiment of the present invention.
Figure 5B:
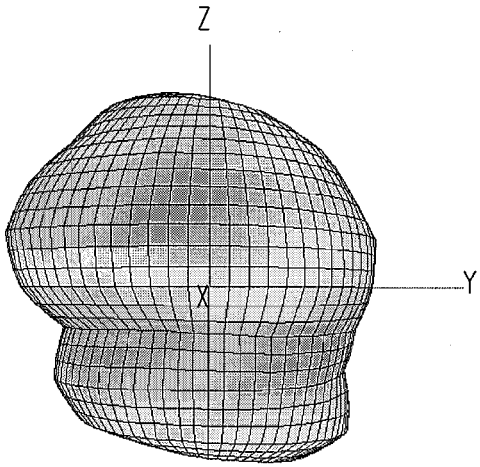
Figure 5C:
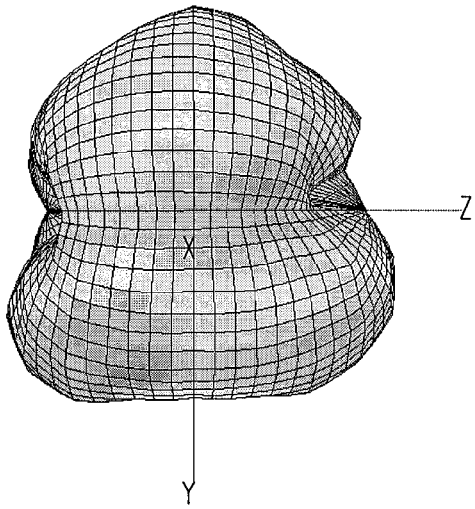

FIGS. 5A-5C are schematic diagrams illustrating radiation patterns of signals transceived by the wireless communication device according to an embodiment of the present invention. FIG. 5A illustrates a radiation pattern of the wireless communication device 1000 of FIG. 2A, wherein the radiation pattern of a direction Z is relatively intense. FIG. 5B illustrates a radiation pattern of the wireless communication device 1000 of FIG. 2B, wherein the radiation pattern of the direction Z is relatively intense. FIG. 5C illustrates a radiation pattern of the wireless communication device 1000 of FIG. 2C, and since the pivot structure 1220 is used to change the direction of the retractable antenna 1200C, the radiation pattern of a direction Y is relatively intense.

A difference between the first embodiment and the second embodiment lies in different lengths of the retractable antenna accommodated in the wireless communication device, and the length is determined according to whether there is the ground point. As described in the first embodiment, when the retractable antenna is accommodated within the wireless communication device, it has a corresponding length $X_1$ of 0.25 times of a resonance wavelength ($\lambda$) when the wireless communication device is operated at the GPS frequency (1575 MHz). In the second embodiment, since there is the ground point, a required length of the resonant wavelength can be adjusted, so that the wireless communication device can be operated at the GPS frequency, and a length $X_2$ of the retractable antenna accommodated within the wireless communication device is greater than the length $X_1$, and the ground point is also different.

In summary, in the embodiments of the present invention, the retractable structure of the retractable antenna of the wireless communication device can be used to change the length of the retractable antenna, and in collaboration with the characteristic that the resonant frequency of the retractable antenna is an odd multiple of the reference frequency rather than an even multiple of the reference frequency, the wireless communication device can use a single retractable antenna to simultaneously support the GPS signals and the DVB-T/H system, so as to effectively reduce a cost of the wireless communication device and improve the utilization convenience. In the embodiments of the present invention, the distance between the feed point and the ground point in the wireless communication device can be adjusted, so that in case of the first antenna length, the ground point is coupled to the retractable antenna, the antenna length of the wireless communication device is adjusted to change the resonant frequency of the retractable antennal, so as to transceive the first signal. Moreover, in case of the second antenna length, the quality of the first signal transceived by the wireless communication device can be improved through the matching circuit. In the embodiments of the present invention, the pivot structure is used to change the direction of the retractable antenna, so that the wireless communication device in the landscape mode can still maintain the qualities of the transceived first signal and second signal, so as to facilitate the user using the wireless communication device.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A wireless communication device, comprising:

a system ground plane, comprising a feed point; and a retractable antenna, electrically connected to the feed point, wherein when the retractable antenna is configured to be a first length, the wireless communication device transceives a first signal of a first bandwidth range through the retractable antenna for a first radio frequency system, and when the retractable antenna is configured to be a second length, the wireless communication device transceives the first signal of the first bandwidth range and a second signal of a second bandwidth range through the retractable antenna respectively for the first radio frequency system and a second radio frequency system, wherein the first signal and the second signal are directly fed into the wireless communication device through the feed point, a center frequency of the first bandwidth range is substantially a first odd multiple of a reference frequency, and a center frequency of the second bandwidth range is substantially a second odd multiple of the reference frequency, wherein the first odd multiple is different to the second odd multiple.

2. The wireless communication device as claimed in claim 1, wherein the second length is greater than the first length.

3. The wireless communication device as claimed in claim 2, wherein the system ground plane further comprises:

a ground point, wherein when the retractable antenna is configured to be the first length, the ground point is coupled to the retractable antenna, and when the retractable antenna is configured to be the second length, the ground point is not coupled to the retractable antenna.

4. The wireless communication device as claimed in claim 3, further comprising:

a conductive material, wherein when the retractable antenna is configured to be the first length, the conductive material is coupled between the ground point and the retractable antenna, and when the retractable antenna is configured to be the second length, the conductive material is coupled to the ground point.

5. The wireless communication device as claimed in claim 1, wherein the first radio frequency system is a global positioning system, and the second radio frequency system is a digital video broadcasting system.

6. The wireless communication device as claimed in claim 1, further comprising:

a global positioning system chip set, coupled to the feed point; and a digital video broadcasting system chip set, coupled to the feed point.

7. The wireless communication device as claimed in claim 1, wherein the retractable antenna further comprises:

a pivot structure, for changing a direction of the retractable antenna.

8. The wireless communication device as claimed in claim 1, further comprising:

a matching circuit, for adjusting the first bandwidth range.

9. The wireless communication device as claimed in claim 1, wherein a resonant frequency of the retractable antennal is an odd multiple of the reference frequency.

10. A wireless communication method, adapted to a wireless communication device comprising a system ground plane and a retractable antenna, the wireless communication method comprising:

configuring the retractable antenna to be a first length, so that the wireless communication device transceives a first signal of a first bandwidth range for a first radio frequency system; and configuring the retractable antenna to be a second length, so that the wireless communication device transceives the first signal of the first bandwidth range and a second signal of a second bandwidth range respectively for the first radio frequency system and a second radio frequency system, wherein the first signal and the second signal are directly fed into the wireless communication device through a feed point electrically connected to the retractable antenna, a center frequency of the first bandwidth range is substantially a first odd multiple of a reference frequency, and a center frequency of the second bandwidth range is substantially a second odd multiple of the reference frequency, and the first odd multiple is different to the second odd multiple.

11. The wireless communication method as claimed in claim 10, wherein the second length is greater than the first length.

12. The wireless communication method as claimed in claim 10, wherein the first radio frequency system is a global positioning system, and the second radio frequency system is a digital video broadcasting system.

13. The wireless communication method as claimed in claim 10, further comprising adjusting the first bandwidth range through a matching circuit.

14. The wireless communication method as claimed in claim 10, wherein a resonant frequency of the retractable antennal is an odd multiple of the reference frequency.

* * * * *